US008087734B2

(12) United States Patent
Nielsen

(10) Patent No.: US 8,087,734 B2
(45) **Date of Patent: *Jan. 3, 2012**

(54) ADJUSTABLE FURNITURE SYSTEMS TO ACCOMMODATE OBJECTS OF VARIOUS DIMENSIONS

(75) Inventor: Andreas K. Nielsen, Valley Center, CA (US)

(73) Assignee: Furniture Designs by Aspen (Mauritius) Limited, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/506,117

(22) Filed: Jul. 20, 2009

(65) Prior Publication Data

US 2010/0148640 A1 Jun. 17, 2010

Related U.S. Application Data

(60) Continuation of application No. 11/266,850, filed on Nov. 3, 2005, now Pat. No. 7,562,949, which is a continuation-in-part of application No. 11/183,208, filed on Jul. 14, 2005, which is a division of application No. 10/925,355, filed on Aug. 23, 2004, now Pat. No. 7,404,609, which is a division of application No. 10/198,204, filed on Jul. 17, 2002, now Pat. No. 6,796,622.

(51) Int. Cl.
*A47B 47/00* (2006.01)

(52) U.S. Cl. ..... 312/7.2; 312/198; 312/107; 312/205

(58) Field of Classification Search ..... 312/204, 312/205, 203, 257.1, 7.2, 223.3, 107, 108, 312/111, 198; D6/432, 436, 437; 108/39, 108/65; 220/8

See application file for complete search history.

(56) References Cited

U.S. PATENT DOCUMENTS

| | | | | |
|---|---|---|---|---|
| 4,325,596 | A * | 4/1982 | Bell | 312/194 |
| 4,813,181 | A * | 3/1989 | Torabi | 49/193 |
| 5,303,057 | A * | 4/1994 | Davidow et al. | 348/836 |
| 6,283,563 | B1 * | 9/2001 | Lambright et al. | 312/205 |
| D458,048 | S * | 6/2002 | Camfferman et al. | D6/436 |
| D487,853 | S * | 3/2004 | Woods | D6/436 |
| 7,562,949 | B1 * | 7/2009 | Nielsen | 312/7.2 |

* cited by examiner

*Primary Examiner* — James O Hansen
(74) *Attorney, Agent, or Firm* — Allen J. Moss; Squire, Sanders & Demspey L.L.P.

(57) ABSTRACT

Furniture systems are delineated including a first cabinet, a second cabinet and a base for supporting a provided object between the first cabinet and the second cabinet. One or both of the first cabinet and the second cabinet defines a space for which, in a first configuration of the system, the base resides outside of the space, and in a second configuration of the system, the base resides at least partially within the space. Accordingly, the delineated furniture systems can accommodate supporting on the base objects of various dimensions.

19 Claims, 12 Drawing Sheets

ADJUSTABLE FURNITURE SYSTEMS TO ACCOMMODATE OBJECTS OF VARIOUS DIMENSIONS

CROSS-REFERENCE TO RELATED APPLICATIONS

This application is a continuation of U.S. patent application Ser. No. 11/266,850, filed Nov. 3, 2005 (now U.S. Pat. No. 7,562,949), which is a continuation-in-part of and claims priority to U.S. patent application Ser. No. 11/183,208, filed Jul. 14, 2005, which is a divisional of and claims priority to application Ser. No. 10/925,355, filed Aug. 23, 2004, (now U.S. Pat. No. 7,404,609) which is a divisional of and claims priority to U.S. patent application Ser. No. 10/198,204, filed Jul. 17, 2002 (now U.S. Pat. No. 6,796,622) each of which are filed in the name of Andreas K. Nielsen and incorporated herein by reference.

FIELD OF THE INVENTION

Embodiments of the present invention relate to furniture such as an entertainment centers and, more particularly, to adjustable furniture systems to accommodate objects of various dimensions.

BACKGROUND OF THE INVENTION

Electronic components for audio and/or audiovisual applications conventionally include multiple, free-standing enclosures that receive power and signals from facility wiring and communicate with other components on wired cables or wireless links. Support for numerous components has conventionally been provided by furniture called an entertainment center. A conventional entertainment center may have open shelving and/or enclosed shelving for supporting and enclosing not only the components but also media used with the components. Such furniture also conventionally provides holes through the back and through the shelving for accommodating the signal cables and power cables associated with the components.

A conventional entertainment center is spaced away from a facility wall to allow cabling to be tucked behind the cabinetry of the entertainment center because provisions for cabling inside the cabinetry of the entertainment center are inadequate. The space between the entertainment center and the facility wall also supplies ventilation air for the components.

Conventional entertainment centers typically provide movable shelving for accommodating electronic components of different vertical height, however, such centers typically provide a fixed horizontal dimension to accommodate a maximum component width.

Thus, use of a conventional entertainment center is limited by the fixed horizontal width of its design. Users of such conventional entertainment centers seeking, for example, to accommodate a larger home theater display (e.g., a big screen television set, a rear projection system, or a front illuminated screen) have little recourse but to purchase new furniture in the event the larger width display does not fit the fixed horizontal width provided by the existing entertainment center.

A large market exists for furniture to support objects such as electronic components, e.g., audio system components and/or audio visual system components which may include stereo system components, television system components, home theater system components and the like. New electronic components and other products of various sizes are frequently launched. Consumers owning conventional entertainment centers for accommodating objects having a horizontal width less than a fixed width associated with the conventional entertainment center may be reticent to purchase new entertainment centers for accommodating objects, e.g., electronic components, having a horizontal width greater than the fixed width associated with the conventional entertainment center. Moreover, such consumers may also forego purchasing newer larger electronic components if the existing fixed-width entertainment centers cannot accommodate the horizontal width of the newer larger electronic components. Consequently, without the present invention, both the consumer electronics and furniture industries face economic impairment.

SUMMARY OF THE INVENTION

In accordance with an embodiment of the invention, a furniture system is disclosed comprising a first cabinet; a second cabinet; and a base for supporting a provided object between the first cabinet and the second cabinet; wherein one or both of the first cabinet and the second cabinet defines a space for which, in a first configuration of the system, the base resides outside of the space, and in a second configuration of the system, the base resides at least partially within the space.

In accordance with another embodiment of the invention, a furniture system is disclosed comprising a first cabinet; a second cabinet; and means for supporting a provided object between the first cabinet and the second cabinet; wherein one or both of the first cabinet and the second cabinet defines a space for which, in a first configuration of the system, the supporting means resides outside of the space, and in a second configuration of the system, the supporting means resides at least partially within the space.

In accordance with still another embodiment of the invention, a furniture system is disclosed comprising a first cabinet including a first internal space; a second cabinet including a second internal space; and a base for supporting a provided object between the first cabinet and the second cabinet; wherein the base resides outside of the first and second internal spaces in a first configuration of the system and at least partially within one or both of the first and second internal spaces in a second configuration of the system.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWING

Embodiments of the present invention will now be further described with reference to the drawings, wherein like designations denote like elements, and.

DETAILED DESCRIPTION OF THE PREFERRED EMBODIMENTS

Figure 1:
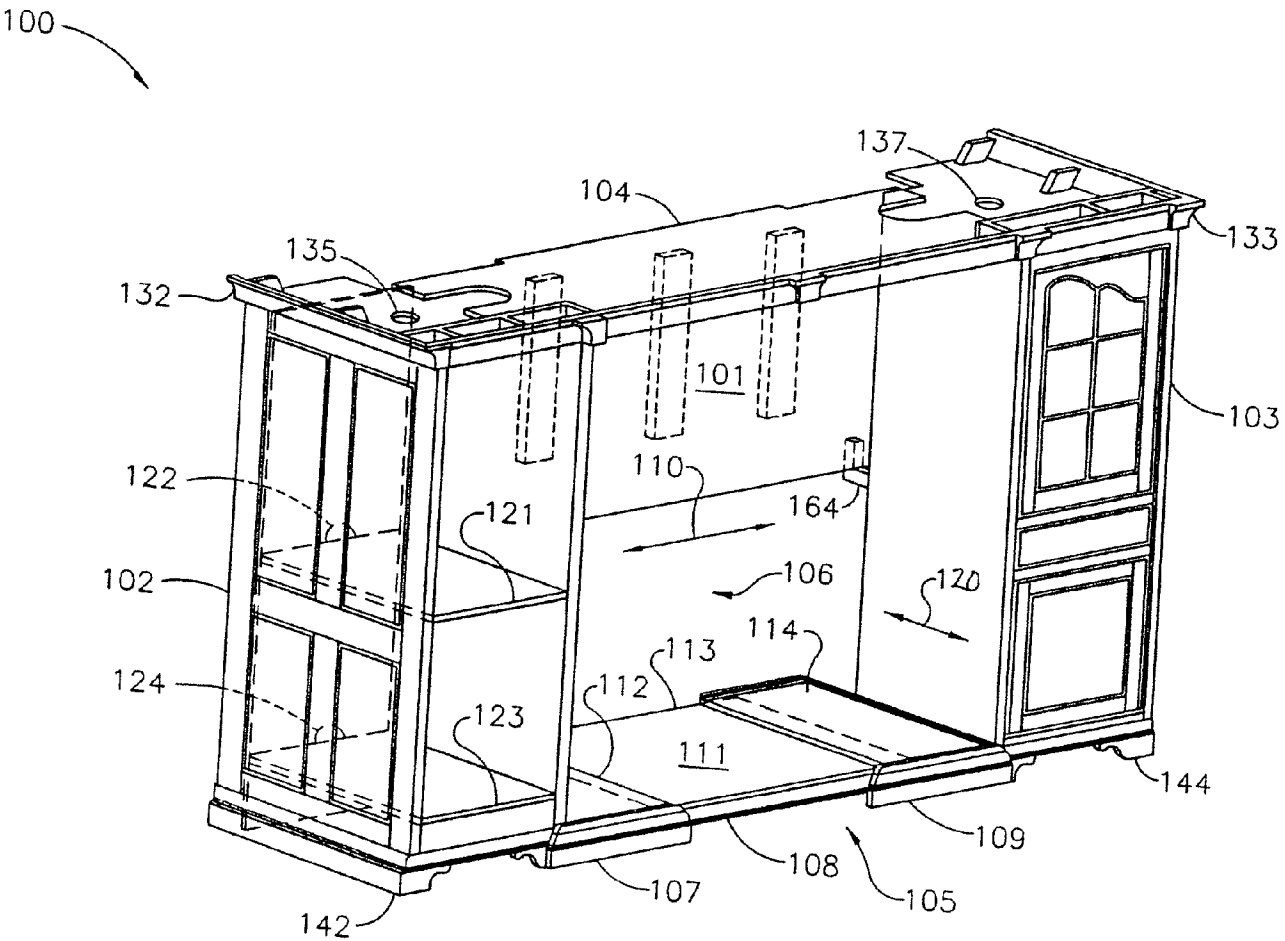
FIG. 1 is a perspective view of a furniture system according to various aspects of the present invention wherein the doors of one of the cabinets are omitted for clarity of presentation.
Figure 2:
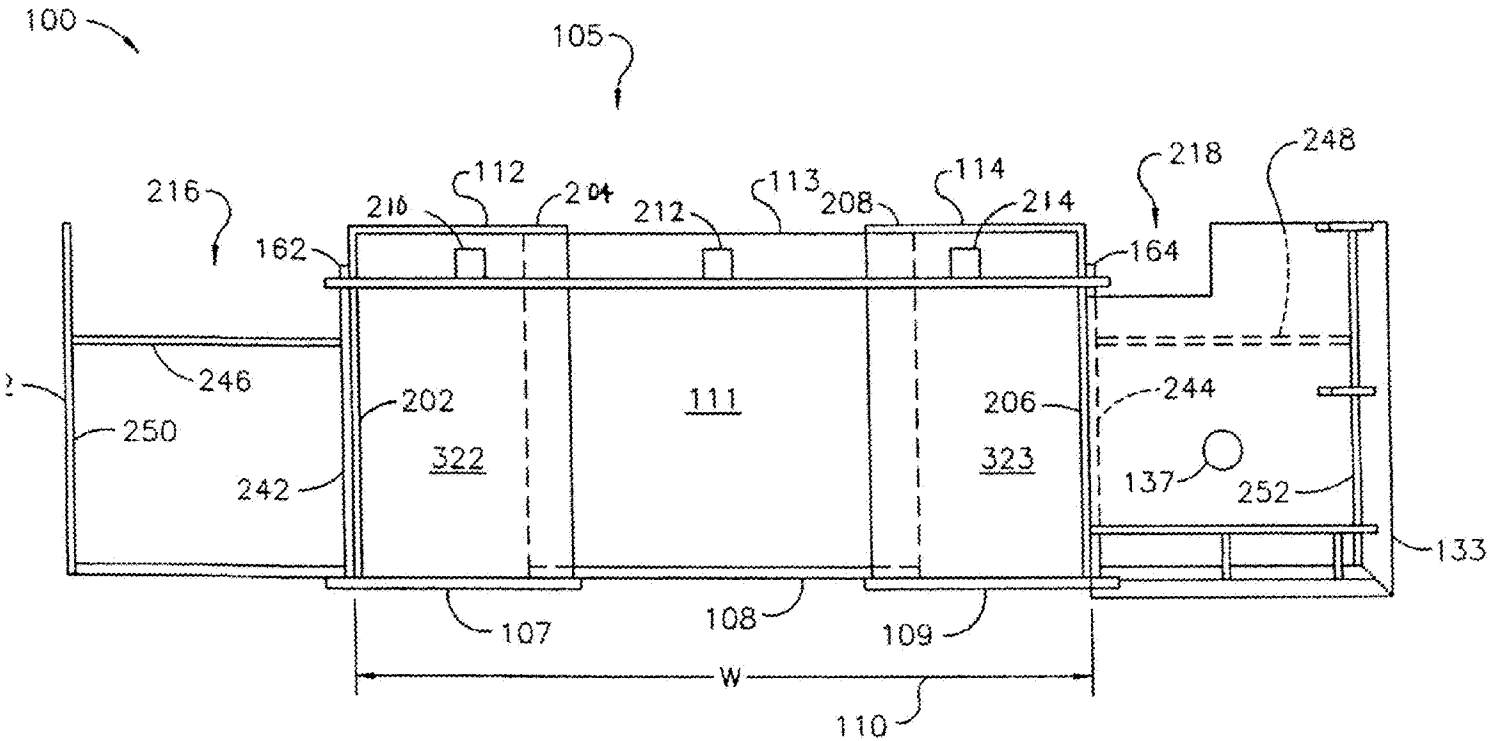
FIG. 2 is a top view of the furniture system of FIG. 1 wherein the bridge and crown of one of the cabinets are omitted for clarity of presentation.
Figure 3:
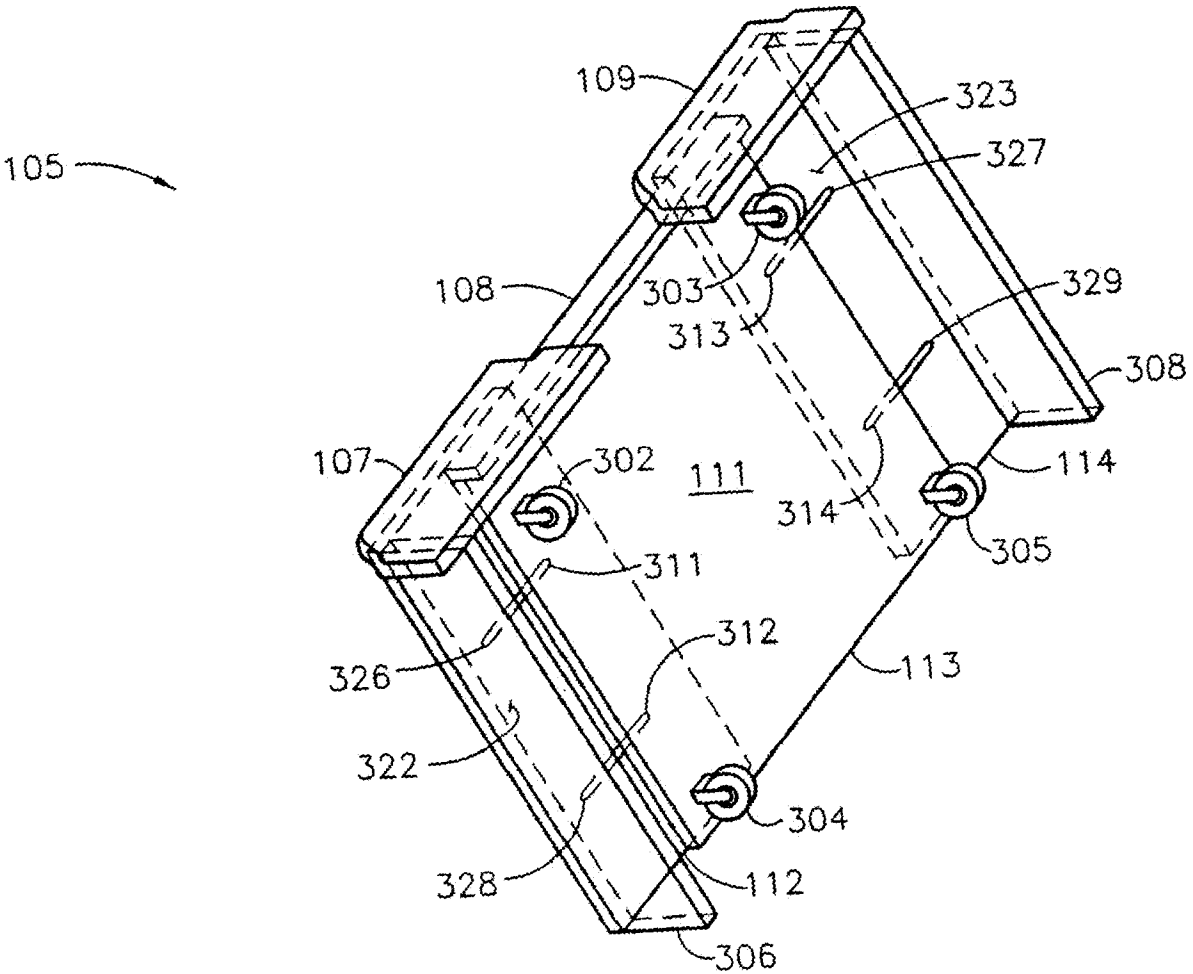
FIG. 3 is a perspective view of the underside of a base for use in the furniture system of FIG. 1.
Figure 4:
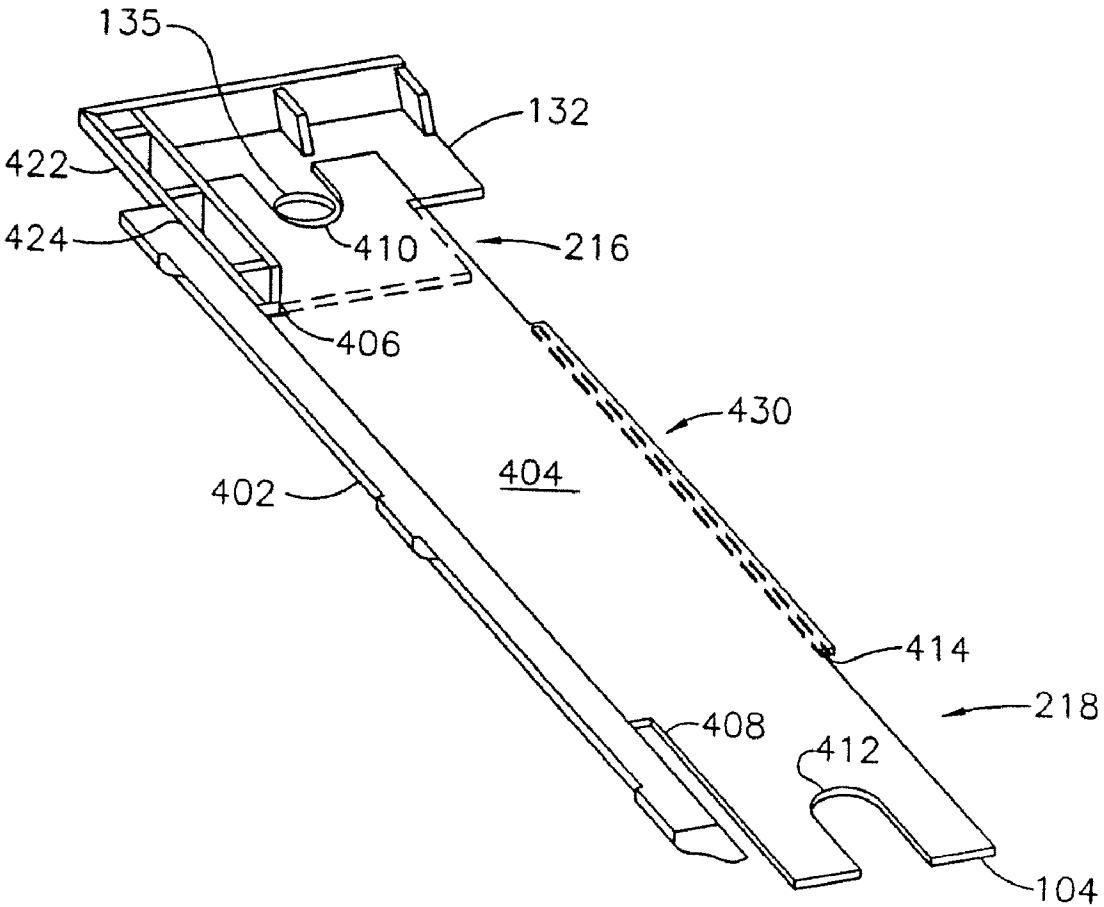
FIG. 4 is a top view of the bridge and a crown of the furniture system of FIG. 1.

A furniture system according to various aspects of the present invention supports any of a variety of home theater displays of various widths. The furniture system generally encloses a space for locating the home theater display, the space being enclosed on several sides, for example, the left side, the right side, and the top. The furniture system may further enclose a portion of the rear of the space. Enclosing is typically for establishing, improving, or cooperating with the interior design of a room where the home theater display is to be used. The enclosure provides ventilation for the display according to various aspects of the present invention.

The display is supported on a base having wheels to transport the base and display as a unit separate from the enclosure portion of the furniture system. The furniture system is typically arranged to abut each vertical side of the home theater display and present to a front view a continuous series of trim surfaces that substantially hide the wheels from view. When the rear of the furniture system is placed against a facility wall, spaces defined by the enclosure accommodate wiring and ventilation and are easily accessible from the front of the furniture system. Conventional materials and techniques of furniture manufacture may be used in the design and construction of furniture systems of the present invention except as described below.

For example, furniture system 100 of FIGS. 1-4 includes cabinets 102 and 103, back panel 101, bridge 104, and base 105. Cabinets 102 (and 103) support component electronics and media (not shown). Each cabinet 102 (103) includes inner side 242 (244), outer side 250 (252), crown 132 (133), any number of suitable shelves 121 and 123, and a cabinet back 246 (248) having holes 122 and 124 through which power and signal cables may be routed. Because outer side 250 (252) extends further to the rear than inner side 242 (244), cabinet 102 (103) defines a space 216 (218) for cabling and ventilation.

A back panel of the furniture system enhances the finished appearance and is retained in a vertical position while cabinets 102 and 103 are moved to establish a suitable width 110 for base 105. For example, back panel 101 is mounted to allow cabinets 102 and 103 to be repositioned without access to the rear of the furniture system to effect a change in mounting of back panel 101. Back panel 101 in one implementation rests on a hook 162 (164) on each cabinet 102 (103) and slides in groove 414 of bridge 104. When cabinets 102 and 103 are positioned closer together or farther apart, back panel 101 slides on hooks 162 and 164 and is maintained in a vertical position by groove 414. Back panel 101 does not obstruct cable passage holes (e.g., 122 and 124) or significantly block ventilation holes in cabinet backs 246 and 248 when cabinets 102 and 103 are positioned for a minimum width 110. Back panel 101 includes stiffeners 210, 212, and 214 to reduce warping.

A bridge provides a visual connection between cabinets, usually at the top of a furniture system, by spanning the width between cabinets. While cabinets are moved to establish a suitable width, the bridge cooperates with the cabinets and the back panel to maintain its position on top of the cabinets. The horizontal position of the bridge can be adjusted (e.g., to center the bridge between the cabinets) without access to the top or rear of the furniture system. A bridge may be supported on the front of crowns of two cabinets and may also be supported via a back panel and hooks on which the back panel is supported. A bridge may have a depth when installed that is substantially equal to the depth of the inner sides of cabinets on which it rests.

For example, bridge 104 rests on the top of cabinet 102 and rests on the top of cabinet 103. Bridge 104 nests with back panel 101 in groove 414 to prevent movement of bridge 104 toward the front of furniture system 100. Preferably, back panel 101 bears no weight of bridge 104 so that back panel 101 slides easily when cabinets are moved. Bridge 104 nests with crowns 132 and 133 via slots 406 and 408 to prevent movement of bridge 104 toward the front or toward the rear of furniture system 100. A front surface 422 of crown 132 (and a symmetric surface of crown 133(not shown)) is overlapped by a portion 402 of bridge 104. When surface 422 includes raised or recessed features, corresponding recesses or raised features may be added to surface 424 to provide an integral appearance when surfaces 422 and 424 are pressed against each other. When supported by cabinets 102 and 103, bridge 104 covers a space 106 between cabinets 102 and 103. Bridge 104 may include conventional lighting to illuminate space 106. In one implementation, bridge 104 is not fastened to either cabinet 102 or 103 but slides on the crown portion 132 and 133 of each cabinet so that bridge 104 is aligned easily over the center of space 106 and flush against crowns 132 and 133. Bridge 104 may further include U-shaped slots for avoiding interference between body 404 of bridge 104 and lighting in crowns 132 and 133 (e.g., installed in apertures 135 and 137).

A crown provides an aesthetically pleasing top to a cabinet and provides support for lighting and a bridge. A crown cooperates with a bridge according to various aspects of the present invention to support the bridge while the cabinet is being moved toward or away from the other cabinet on which the bridge is supported. For example, crowns 132 and 133 cooperate with bridge 104 as discussed above. Further, crowns cooperate with a bridge of the present invention to provide an aperture 430 for convection cooling of the home theater display and any entertainment equipment components located within cabinets 102 and 103. Aperture 430 includes a portion 216 rear of cabinet back 246, a portion 218 rear of cabinet back 248, and a portion 430 above base 105. Rear panels, crowns, and/or a bridge of furniture system 100 may include any conventional grills, hole patterns, slots, or voids to facilitate cooling.

A base, according to various aspects of the present invention provides an adjustable width so as to support one of various width home theater displays and provides a concealed mechanism for moving the base in and out of position between cabinets of the furniture system. Such a base includes sections mechanically coupled to each other and capable of being positioned with respect to each other to provide a base having one of various overall widths. Any mechanical coupling technique may be used to provide discrete or continuously variable positions. Concealment of wheels may be accomplished by expandable trim surfaces, where expansion is accomplished by overlapping, telescoping, deploying, or stretching trim surfaces. A deployed trim surface may be stored as rolled stock in the base. Stretching may include elastic, pleated, or accordioned material. For example, base 105 of FIGS. 1-4 includes stage 113, section 112 attached to stage 113 by integral slides, and section 114 attached to stage 113 by integral slides. The stage provides wheels for movement of the base; and the sections and the stage provide cooperative overlapping trim surfaces to conceal the wheels. A trim surface of each section overlaps a portion of the nearest cabinet that abuts the base.

A stage provides support for at least one section and provides transportation for an object placed on the stage or on the section. For example, stage 113 includes platform 111, casters 302-305, studs 311-314, and trim piece 108. Section 112 (114) includes platform 322 (323), side 306 (308), and trim piece 107 (109). Platform 322 (323) includes a pair of slots 326 (327) and 328 (329) for attaching the section to the stage. The underside of section platforms 322 and 323 bears on the an upper side of stage platform 111. Studs 311-314 pass through slots 326-329 to accept a stud termination (e.g., a fender washer and nut). Each slot, stud, and termination cooperate to form a slide for mechanically coupling a section to the stage. By loosening stud terminations, each section 112 and 114 may be moved along its respective slides (e.g., along axis 110) toward and away from the center of platform 111. By moving each section a proportional distance from the center of platform 111, base 113 is extended to any width (W) 110 within the range of the slides. After moving the sections, any suitable lock (e.g., a locking mechanism) may be employed to secure the position, fix the overall width of stage 113, and more efficiently transfer load borne by base 105 to casters 302-305. For example, stud terminations may be tightened to draw and bind the stage and section together.

Casters 302-305 are fixed to an underside surface of platform 111 and provide load bearing support. Each caster pivots around a vertical axis. Each caster provides a wheel that rotates on a horizontal axis. Any conventional caster may be used. A home theater display placed onto base 113 may rest in part against an upper surface of platform 111 and/or on an upper surface of section platforms 322 and 323. Weight of the display is communicated via slides to stage 113 and through casters 302-305 to the facility surface on which furniture system 100 is placed. In operation, casters 302-305 facilitate movement of stage 113 (and a display placed on stage 113) along an axis of width 110 so to align stage 113 between cabinets 102 and 103, and along an axis of depth 120 so to move stage 113 into space 106. A home theater display atop stage 113 may completely fill the width 110 and depth 120 of space 106.

The space directly below stage platform 111 is substantially hidden from view by the cooperation of trim pieces 107-109. Trim piece 107 (109) extends away from the center of platform 111 and beyond the extremity of platform 322 (323) to overlap a portion of cabinet 102 (103) and consequently to cover any portion of space 106 that might remain between base 113 and cabinet 102 (103). Trim piece 107 (109) also extends toward the center of platform 111 to overlap a portion of trim piece 108. When section 112 (113) is slid toward or away from stage 111, trim piece 107 (109) slides in front of trim piece 108 to continue to perform the hiding function.

Each section 112 and 114 may further include a railing on one or more edges of the section to reduce the risk that an object placed on the base will unexpectedly slide off the base. For example, section 112 (114) may further include side 306 (308) that extends above platform 322 (323) to form a lip 202 (206). Railings may be added to the upper surfaces of any platform 111, 322, and/or 323. For example, railing 204 (208) is added on the top rear edge of platform 322 (323).

Movement of base 105 is facilitated in any conventional manner. According to various aspects of the present invention, base 105 provides at least one handle or hand-hold to move base 105. For example, trim piece 108 extends downward yet leaves space for a user to place his or her hand or hands under trim piece 108 and pull on trim piece 108 to move base 105 on depth axis 120 out from between cabinets 102 and 103. In an alternate implementation, platform 111 is formed with a hand access hole through platform 111 to facilitate pulling base 105 on depth axis 120 out from between cabinets 102 and 103.

Assembly of an entertainment system with an entertainment furniture system as discussed above may proceed according to a method performed in any order as follows. Measure the width of the home theater display to be positioned in space 106. Determine whether it is desired to abut both cabinets 102 and 103 to the sides of the home theater display, and if not add a suitable amount to the width. Assemble sections 112 and 114 to stage 113. Before tightening stud terminations, extend each section 112 and 114 symmetrically from the center of stage 113 an amount equal to about half the desired width, then lock the sections to the stage (e.g., by tightening the stud terminations). Place back panel 101 against a facility wall. Place cabinet 102 within a few inches of the facility wall as desired, allowing for access to cable TV, power, telephone, Internet, and other facility wiring connections for use by the entertainment system. Place cabinet 103 roughly the desired width from cabinet 102. Lift back panel 101 onto hooks 162 and 164. Place bridge 104 on top of the crown portions of cabinets 102 and 103, centering bridge 104 over space 106, and fitting bridge 104 onto back panel 101 for maintaining back panel 101 in a vertical position. Move cabinets 102 and/or 103 to obtain the desired width of space 106. While cabinets 102 and 103 are being moved apart (or together), back panel 101 is confined to slide along groove 414 while being maintained in a vertical position, and bridge 104 is confined to slide along a plane coplanar to the top of cabinets 102 and 103. If cabinet lighting is provided in bridge 104 or crown portions of cabinets 102 and 103, connect power wiring. Place a home theater display on base 105 and transport the base and display as a unit to a position in front of space 106. Place all other entertainment system components (e.g., tuner, amplifier, audio media player, speakers) in cabinets 102 and 103. Route all cables and wiring from the display to the components. Reach around cabinet inner side 242 (244) to access cables passing through holes 122 and 124 (and suitable holes in cabinet back 248 (not shown)). Transport the base and display as a unit into space 106 until the trim pieces 107 and 109 meet and overlap a portion of the front trim pieces 142 and 144 of cabinets 102 and 103.

Another furniture system according to various aspects of the present invention may include a base as discussed above and an enclosure. The enclosure may include: (a) shelving to one side of a space to be occupied by the base; and (b) a vertical panel on the opposite side of the space. The enclosure may include a bridge and/or a back panel that spans the top and/or rear sides of the space. For example, such a furniture system may include all of the structures discussed above with reference to system 100, except that: (a) cabinet 102 is replaced by a panel similar to side 250 (e.g., omitting crown, doors, drawer, shelves, as well as front, inside, and rear structures) and supported by being attached to either a back panel similar to 101 and/or to a bridge similar to 104; and (b) bridge 104 is replaced with a bridge modified to attach to or cooperate with side 250 (e.g., omitting all of the structure associated with resting on top of and cooperating with a full size cabinet 102). The structures and cooperation of the bridge and cabinet 103 would be included in this alternate furniture system. The asymmetric implementation discussed here (cabinet to the right of display) may be implemented as a mirror image (cabinet on left of display) in an alternate implementation.

In alternative implementations of the furniture systems discussed above, cabinet doors and drawers are partially or entirely omitted. In still further alternate implementations, any arrangement of shelving, doors, and/or drawers may be located between sides 244 and 252 (and/or sides 250 and 242 if implemented).

Another alternate furniture system according to various aspects of the present invention includes merely a base as discussed above (cabinets 102 and 103, bridge 104, and back panel 101 are omitted).

FIGS. 5-12 depict another embodiment of a furniture system 1000 in accordance with systems of the present invention. Furniture system 1000 may generally include a cabinet 1002, a cabinet 1004 and a base 1006. Furniture system 1000 may also include a light bridge 1008 and one or more adjustable shelves 1010. Furniture system 1000 may be fabricated using any desired materials or manufacturing techniques. Furniture system 1000 may generally be employed to store and/or support any desired objects.

Figure 5:
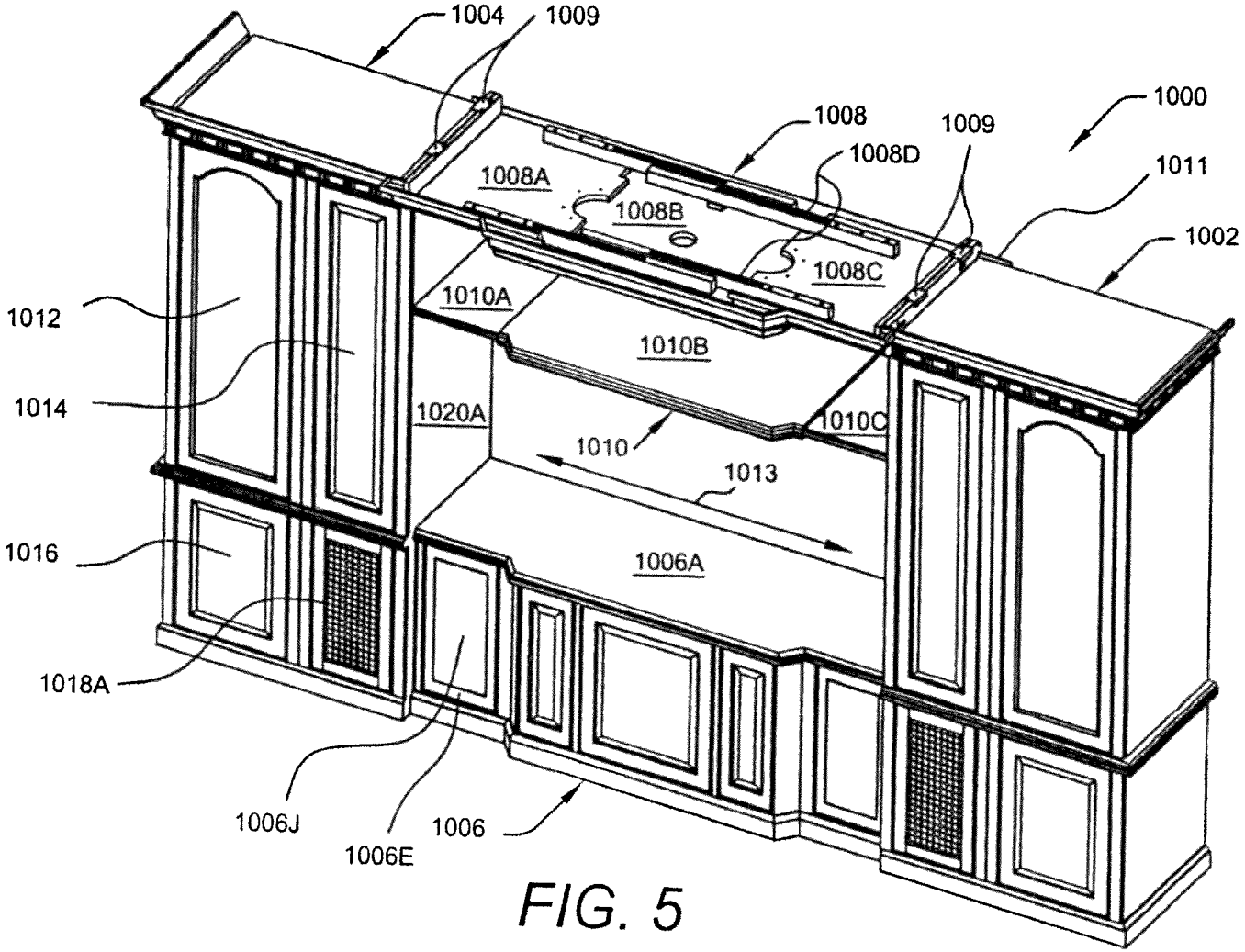
FIG. 5 is a perspective view of another embodiment of a furniture system, in accordance with systems consistent with the present invention.
Figure 9:
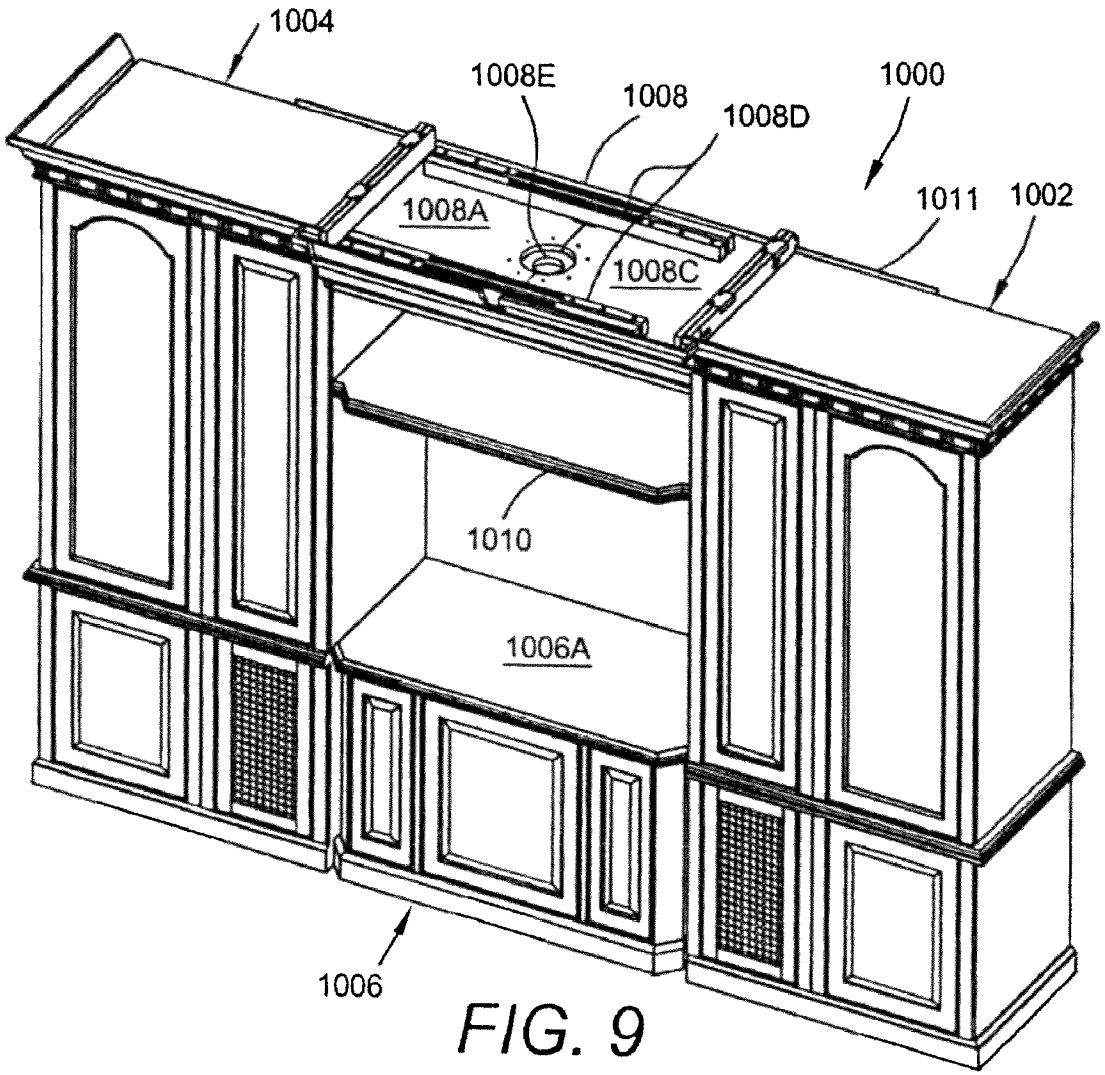
FIG. 9 is a perspective view of the furniture system of FIG. 5 shown in a reduced-length configuration, in accordance with systems consistent with the present invention.

For example, furniture system 1000 may be employed to store and/or support any home entertainment system, which may include a television of any kind, stereo equipment, systems for receiving a broadcast signal such as a satellite system, a DVD player and/or recorder, a VHS player and/or recorder, one or more speakers and the like. Typically, the television in such systems is supported on base 1006. Moreover, televisions come in a variety of different sizes. To accommodate televisions, or other objects, of different sizes, furniture system 1000 may be adjusted along an axis 1013. For example, furniture system 1000 is shown in FIG. 5 in an expanded configuration to accommodate televisions of a predefined maximum width, while furniture system 1000 is shown in FIG. 9 in a retracted configuration to accommodate televisions of a predefined minimum width. Furniture system 1000 may accommodate televisions of any width between the two limits represented in FIGS. 5 and 9.

Figure 6:
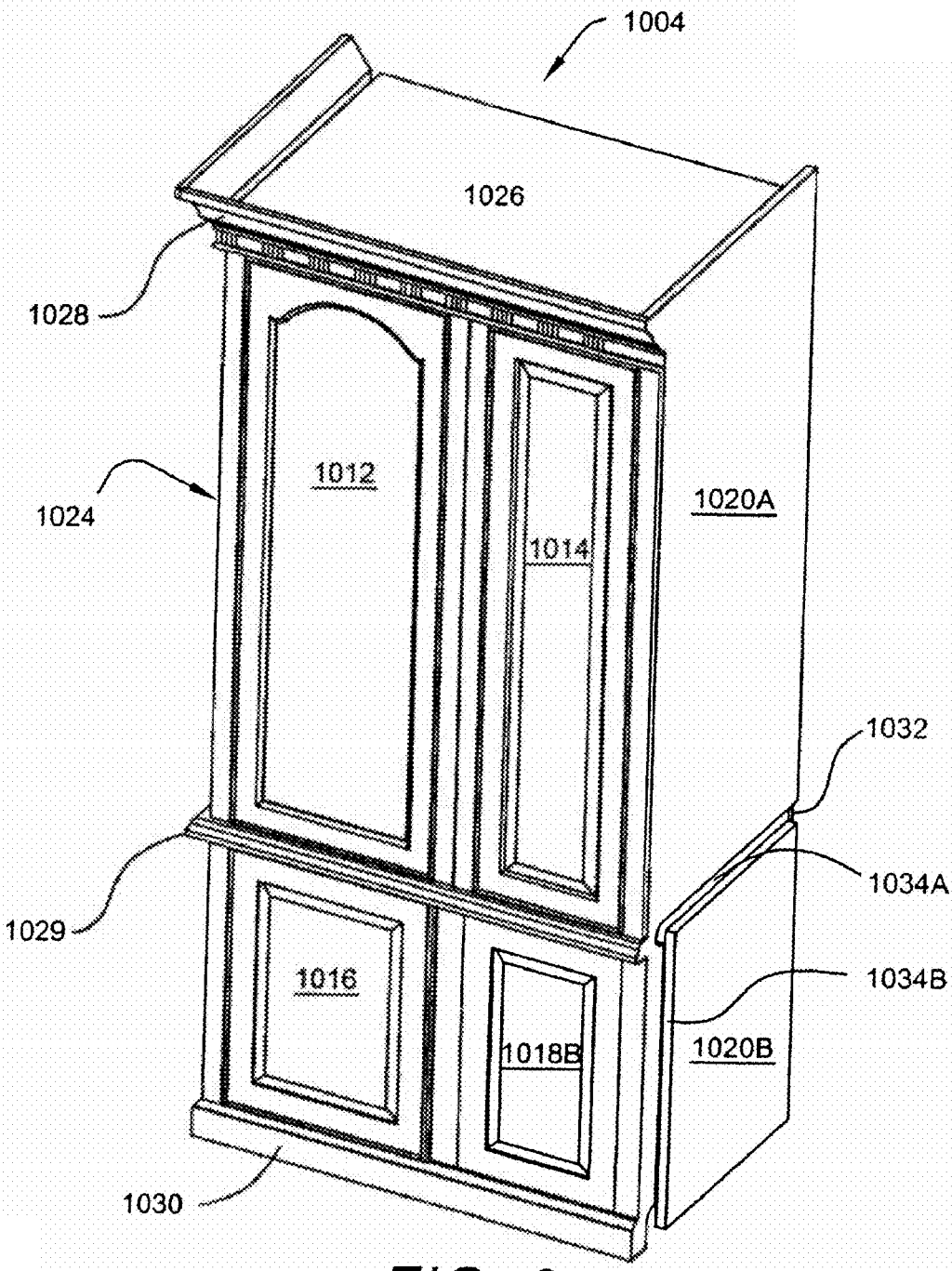
FIG. 6 is a perspective view of a cabinet of the furniture system of FIG. 5, in accordance with systems consistent with the present invention.

Referring to FIG. 6, cabinet 1004 is shown in perspective view. Cabinet 1004 may include a top member 1026, a side member 1024, a side member 1020 (including side members 1020A and 1020B) and a back member 1032. One or more apertures (not shown) may be included in back member 1032 to facilitate the running of electrical connections between any electrical components that may be stored in cabinet 1004 and a television that may be supported on base 1006 or any other desired electrical connection point, e.g., a wall outlet. Cabinet 1004 may include doors 1012, 1014, 1016 and 1018 on the front face of cabinet 1004. Molding 1028-1030 may also be included, respectively located at the top, between upper doors (1012 and 1014) and lower doors (1016 and 1018) and bottom of cabinet 1004. Doors 1012-1018 may be conventionally hinged to permit the closure and opening thereof. Dividing members (not shown) may be employed to separate the respective compartments behind doors 1012-1018. Moreover, shelving or other systems (not shown) for supporting and/or storing any desired objects (not shown), e.g., electronic components, may be employed behind any of doors 1012-1018.

To clarify, door 1018 is identified as 1018B in FIG. 6 and as 1018A in FIG. 5 to distinguish between variations of door 1018. Specifically, one embodiment of door 1018 may have a removable center panel, which may comprise any desired material. For example, in FIG. 5 door 1018 includes a center panel with a speaker-grill material, while the center panel in FIG. 6 is a solid material, e.g., a wood or other suitable material. The use of a speaker-grill material, e.g., a woven fibrous material, for a center panel may permit sound from one or more speakers which may be located behind a door having a center panel with the speaker-grill material to pass with minimum distortion, as compared to a door with a solid center panel. The use of a solid material for a center panel in a door may enhance the overall durability of the door and the appearance of the system 1000.

A center panel, when employed in door 1018 or in any other door, may be removable or fixed. In the former case, the center panel may be removably coupled to the inner perimeter of a door by any connecting technique, e.g., a hook and loop fastener. Any door in furniture system 1000 may include either a removable or a fixed center panel, whether employing a speaker-grill material, a solid material or other material. However, any door in furniture system 1000 may have neither a removable, nor a fixed center panel, i.e., no center panel. Moreover, no panel, whether removable or fixed, needs be centered in a door and there may be more than one panel in a door.

Still referring to FIG. 6, side member 1020 of cabinet 1004 may include side members 1020A and 1020B. An aperture 1034 may reside between side members 1020A and 1020B. To clarify, side members 1020A and 1020B may be supported by being coupled to back member 1032, as well to shelves behind doors 1014 and 1018. As shown in FIG. 6, aperture 1034 may comprise a plurality of aperture segments 1034A and 1034B. Aperture 1034 may comprise an entry point to a space or a cavity that may extend into a region behind door 1018. The cross-sectional shape of this space or cavity behind door 1018 may resemble the shape of aperture 1034, e.g., a configuration of two or more linear segments intersecting orthogonally. Thus, a like-shaped space or cavity (like that of aperture 1043) may reside in cabinet 1004, behind door 1018. As discussed below, this space or cavity may be employed to permit adjusting the length of furniture system 1000 by permitting the selective movement of base 1006 between one configuration where base 1006 resides outside of cabinets 1002 and 1004 and another configuration where base 1006 resides partially within one or both of cabinets 1002 and 1004. The size, shape and location of aperture 1034 (and the corresponding space or cavity behind door 1018) may take on any size, shape and location suitable to accommodate a portion of base 1006 which may be inserted therein to permit such adjustment.

Figure 7:
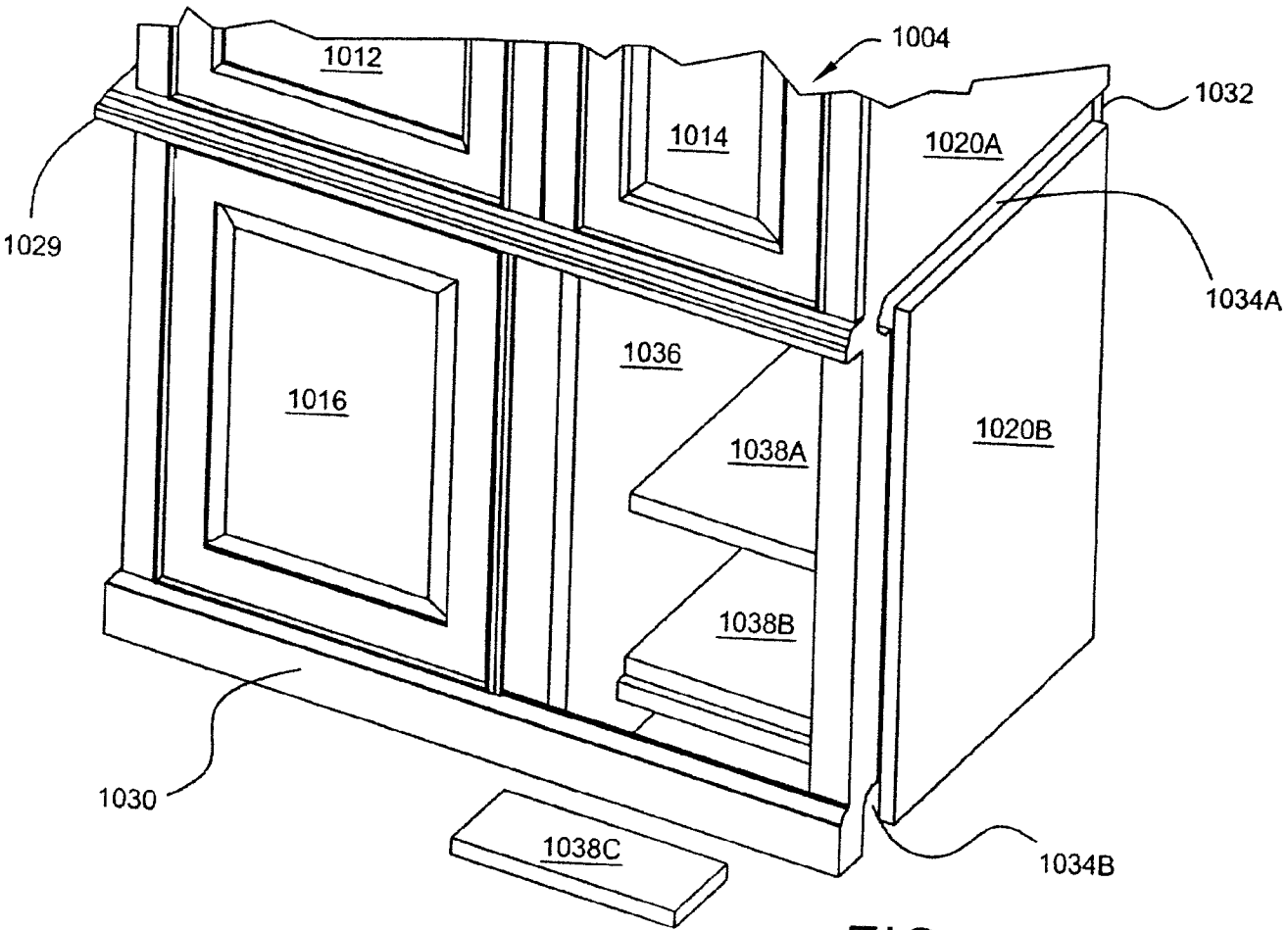
FIG. 7 is a perspective view of a portion of the cabinet of FIG. 6 (with a cabinet door removed to show part of a shelf removed to facilitate adjusting the length of the system), in accordance with systems consistent with the present invention.
Figure 8:
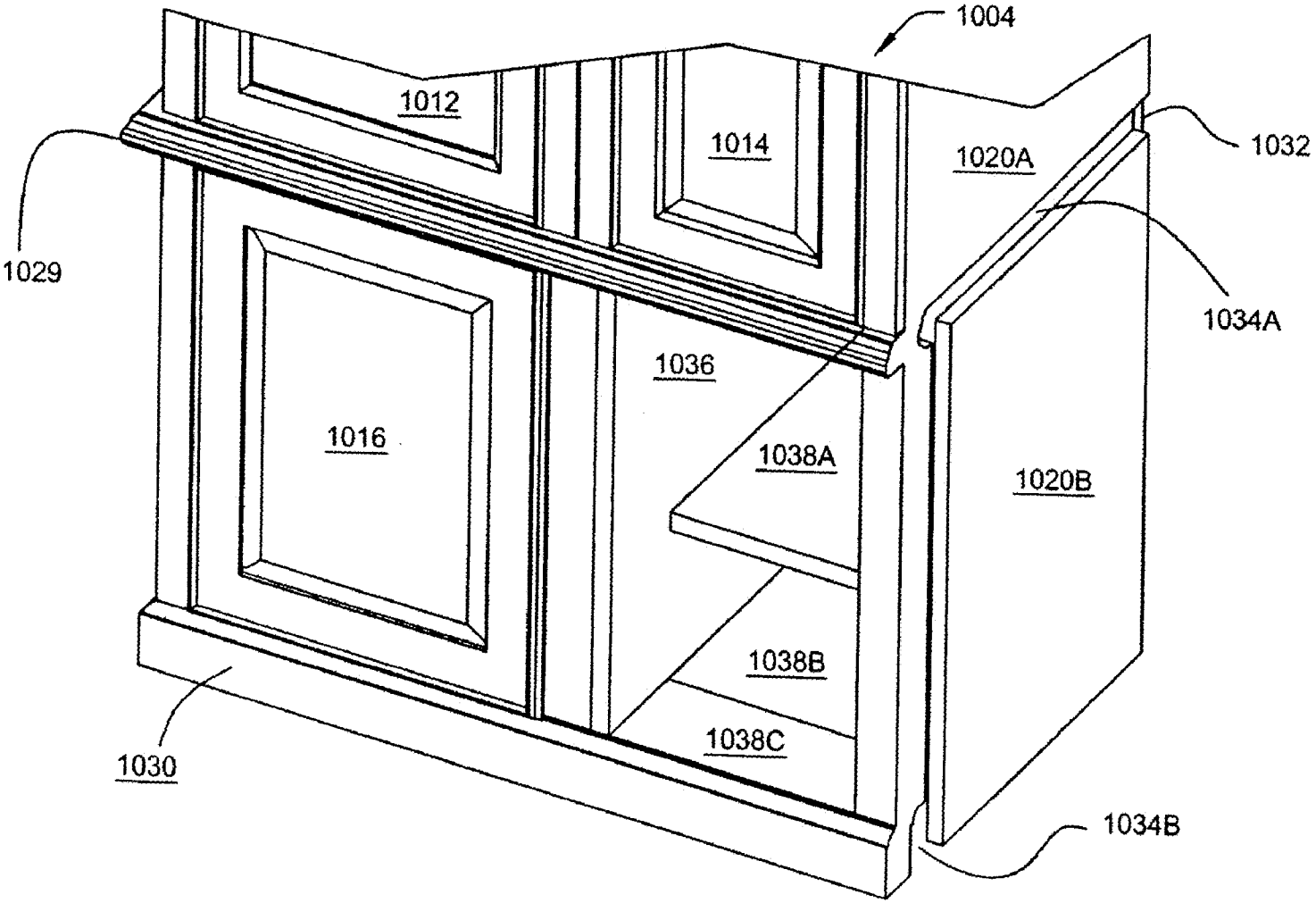
FIG. 8 is a perspective view of a portion of the cabinet of FIG. 6 (with a cabinet door removed to show part of a shelf installed to inhibit adjusting the length of the system below a specified minimum length), in accordance with systems consistent with the present invention.

Referring to FIG. 7, door 1018 is not shown to reveal the region normally hidden by the closure of door 1018. Specifically, an interior side wall 1036 may serve to divide the region behind door 1018 with the region behind door 1016. Shelves 1038A and 1038B are also shown. A portion 1038C of shelf 1038B is shown removed from shelf 1038B. The normal position of portion 1038C is installed, as shown in FIG. 8, to prevent objects from falling off of and then under shelf 1038B. However, to facilitate adjustment of the system length by moving a portion of base 1006 into cabinet 1004, portion 1038C may be removed, as shown in FIG. 7. Portion 1038C may be held in place by mechanical fit or any suitable means and may be removed by any suitable means. Moreover, if desired, portion 1038C may be omitted, i.e., eliminating the need to remove it prior to system adjustment.

Cabinet 1002 may be constructed and arranged similarly to cabinet 1004, the aperture in cabinet 1002 residing in the interior side member of cabinet 1002, i.e., on the side closest to base 1006. The size, shape and location of the aperture in cabinet 1002 (and the corresponding space or cavity behind the corresponding lower interior door) may take on any size, shape and location suitable to accommodate a portion of base 1006 which may be inserted therein to permit system adjustment. Such size, shape and location may be the same as or different from that for cabinet 1004. Moreover, those skilled in the art appreciate that one of the cabinets 1002 or 1004 may not have any aperture, resulting in cabinet-to-base adjustability for only one of cabinets 1002 and 1004. Preferably, however, both cabinets 1002 and 1004 have apertures and facilitate cabinet-to-base adjustability.

Referring to FIG. 9, system length has been reduced, as compare to that shown in FIG. 5. This is facilitated by an adjustable light bridge 1008, an adjustable shelf 1010, an adjustable back panel 1011 and the adjustability of the base-to-cabinet interface.

For example, adjustable light bridge 1008 may include sections 1008A, 1008B and 1008C. Sections 1008A and 1008C may be coupled by connectors 1009 to cabinets 1004 and 1002, respectively. Rails 1008D may be connected to sections 1008A and 1008C, while posts residing within and constrained by respective rail channels may be attached to section 1008B, permitting adjustment of light-bridge length. An illumination source, e.g., one or more lights, may be electrically and/or mechanically coupled through aperture 1008E. A groove in a lower surface of light bridge 1008 may constrain the movement of back panel 1011. Any other light bridge structure with adjustability along axis 1013 may be employed.

Similarly, any shelf structure with adjustability along axis 1013 may be employed for adjustable shelf 1010. For example, adjustable shelf 1010 may include sections 1010A, 1010B and 1010C. Sections 1010A and 1010C may be coupled to cabinets 1004 and 1002, respectively. Section 1010B may include recessed groove portions on a lower surface thereof for permitting sliding engagement with sections 1010A and 1010C.

Adjustable back panel 1011 may be supported by a plurality of hooks coupled to cabinets 1002 and 1004 (as shown with respect to the embodiments of FIGS. 1-4). Moreover, the groove in the lower surface of light bridge 1008 may constrain the movement of back panel 1011. Accordingly, adjustable back panel 1011, while not telescopic like adjustable light bridge 1008 and adjustable shelf 1010, though it could be, if desired, is constrained to reside in a plane coplanar to back panel 1011, though back panel 1011 may slide along the groove in light bridge 1008 and the hooks coupled to cabinets 1002 and 1004 when system 1000 is adjusted along axis 1013.

The adjustability of the base-to-cabinet interface may be facilitated by aperture 1034 and its corresponding space or cavity in cabinet 1004, the aperture (not shown) and its corresponding space or cavity (not shown) in cabinet 1002 (assuming both cabinets 1002 and 1004 have such apertures) and base 1006 having ends which may slide within such apertures.

Figure 11:
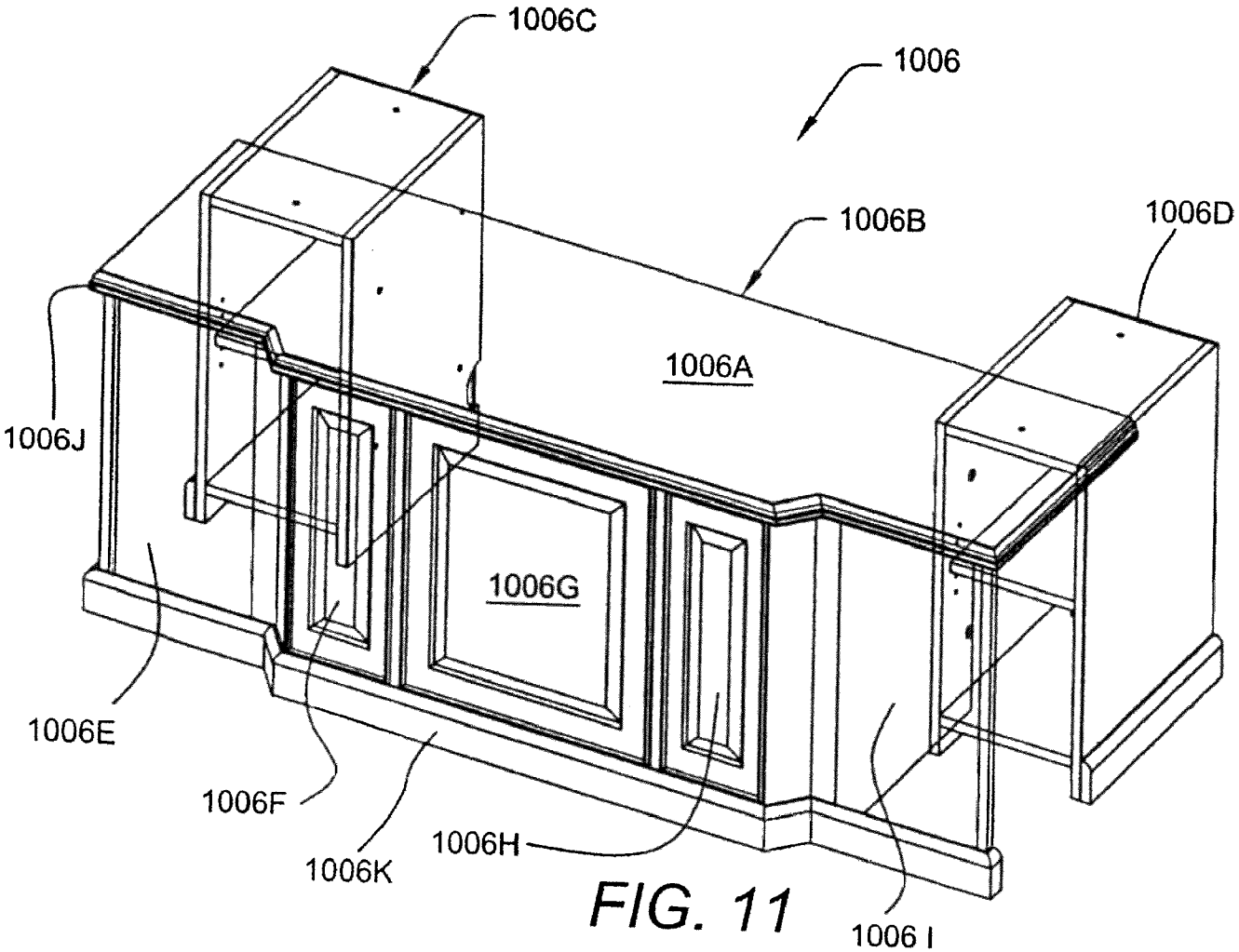
FIG. 11 is a perspective view of a base of the furniture system of FIG. 5 (shown with the removable modules of FIG. 10 detached), in accordance with systems consistent with the present invention.
Figure 12:
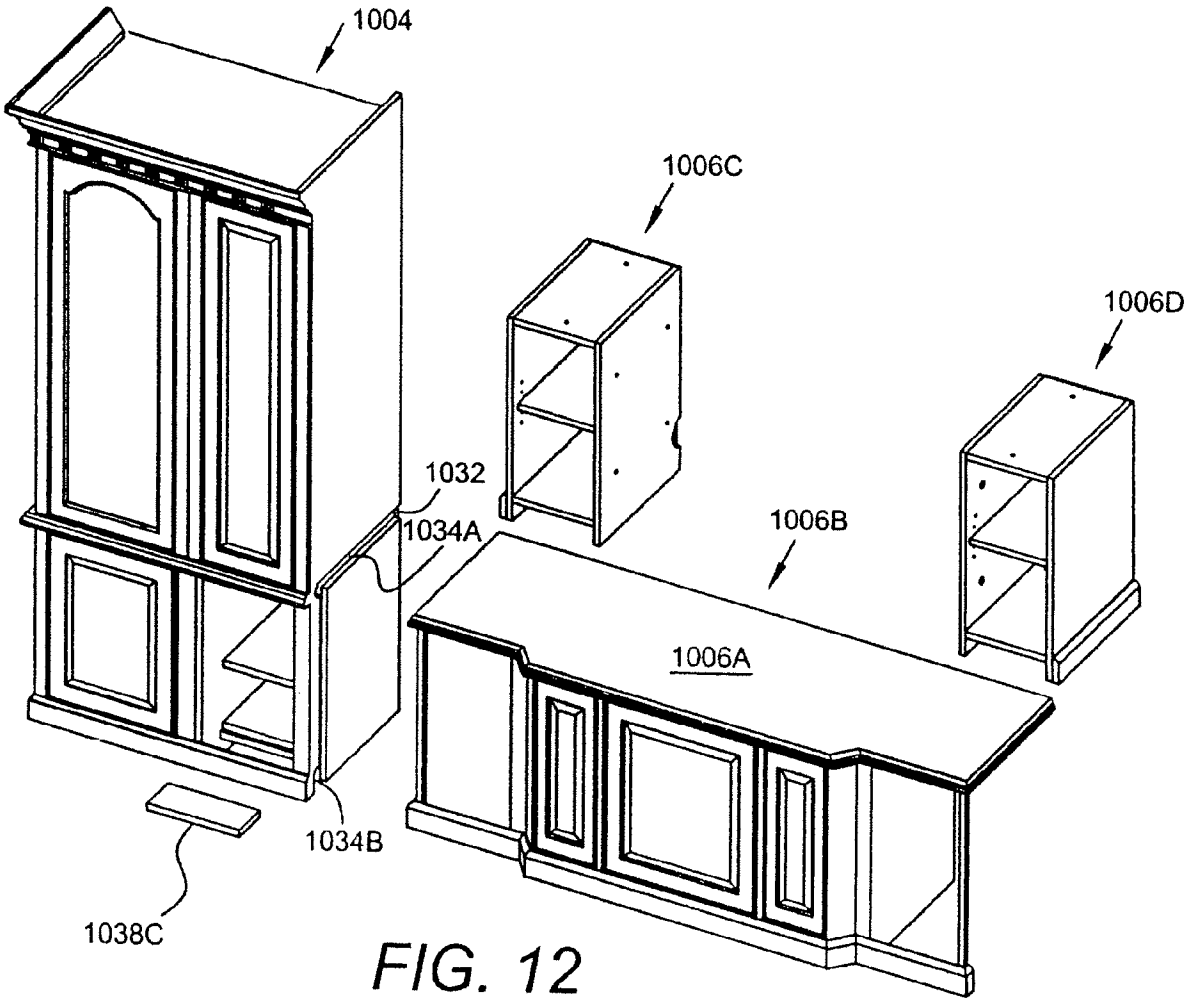
FIG. 12 is a perspective view of portions of the furniture system of FIG. 5, in accordance with systems consistent with the present invention.

Referring to FIGS. 11 and 12, base 1006 is shown in perspective view with removable modules 1006C and 1006D broken away. Base 1006 may include a top member 1006A, a back member 1006B, a removable module 1006C and a removable module 1006D. The term "module" as used herein shall mean one or more members for coupling to a structure for some purpose. One or more apertures (not shown) may be included in back member 1006B to facilitate the running of electrical connections between any electrical components that may be stored in base 1006 and a television that may be supported on base 1006 or any other desired electrical connection point, e.g., a wall outlet or another electrical component in either of cabinets 1002 or 1004. Base 1006 may include doors 1006E, 1006F, 1006G, 1006H and 1006I on the front face of base 1006. Molding 1006 J and 1006K may also be included, respectively located at the top and bottom of base 1006. Doors 1006E-1006I may be conventionally hinged to permit the closure and opening thereof. Dividing members (not shown) may be employed to separate the respective compartments behind doors 1006E-1006I. Moreover, shelving or other systems (not shown) for supporting and/or storing any desired objects (not shown), e.g., electronic components, may be employed behind any of doors 1006E-1006I.

Figure 10:
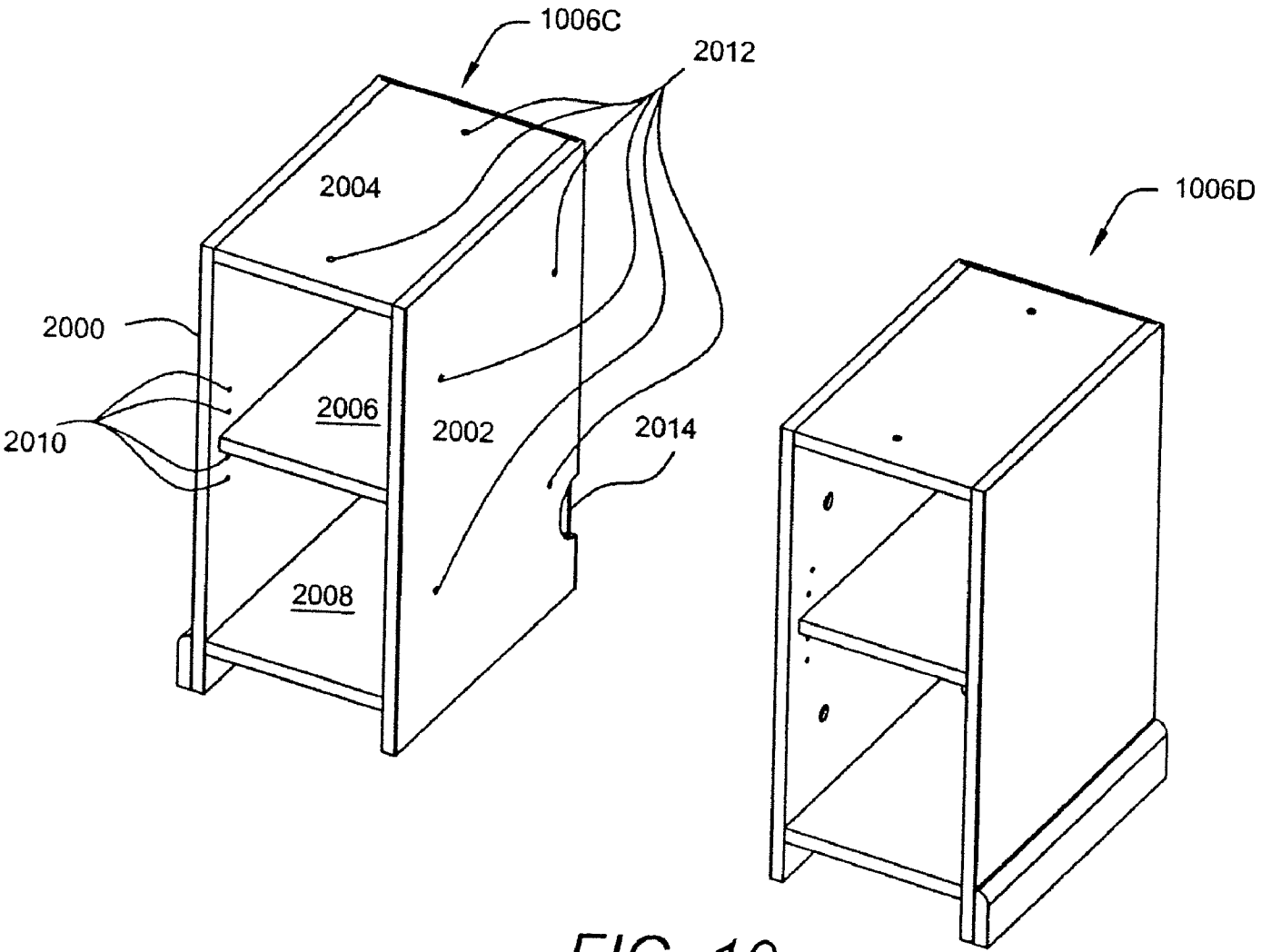
FIG. 10 is a perspective view of a pair of removable modules that may be employed with a base of the furniture system shown in FIG. 5, in accordance with systems consistent with the present invention.

FIG. 10 shows removable modules 1006C and 1006D in perspective isolated view. Removable module 1006C may include a top member 2004, a side member 2000, a side member 2002, a back member 2014 and shelves 2006 and 2008. Apertures 2010 permit vertical adjustment of shelf 2006, though similar apertures may permit vertical adjustment of shelf 2008. Additional or fewer shelves may be employed. Apertures 2012 facilitate coupling of removable module 1006C to base 1006. Any suitable connector may be employed to couple removable module 1006C to base 1006 using apertures 2012 or any other suitable connection points. Removable module 1006D may be similarly constructed and arranged.

With removable modules 1006C and 1006D installed to base 1006, base 1006 may function separate and apart from furniture system 1000 as an independent furniture system, e.g., a console. In this configuration, base 1006 is fully enclosed, i.e., it has a top side enclosure, a back side enclosure, a left side enclosure, a right side enclosure and a front side enclosure. In this configuration, base 1006 may also be used in furniture system 1000, for example, as shown in FIG. 5 where system 1000 is opened to maximum width along axis 1013. In this configuration, base 1006 resides outside of cabinets 1002 and 1004, substantially adjacent to aperture 1034 in cabinet 1004 and the aperture (not shown) in cabinet 1002 (assuming both cabinets 1002 and 1004 are used to adjust system width).

With removable modules 1006C and 1006D detached from base 1006, base 1006 may function as part of furniture system 1000. For example, one may detach removable modules 1006C and 1006D by removing fasteners at apertures 2012. Back member 1006B does not extend into the region behind doors 1006E and 1006I, i.e., where removable modules 1006C and 1006D may reside. Thus, with removable modules 1006C and 1006D detached from base 1006, the ends of base 1006 correspond to the shape of aperture 1034 in cabinet 1004 and the aperture (not shown) in cabinet 1002 (assuming it has the same size, shape and location as aperture 1034). Door 1006E may include a removable center panel 1006J, as shown in FIG. 5, which may be removed to facilitate access to shelves behind door 1018A once base 1006 is inserted into cabinet 1004. Door 1006I may similarly include a removable center panel, which may be removed.

Thus, to employ furniture system 1000 in a fully-expanded mode, i.e., to accommodate a predefined maximum width object between cabinets 1002 and 1004 such as a television, one may leave removable modules 1006C and 1006D attached to base 1006. This permits using base 1006 independently of cabinets 1002 and 1004, if desired. It also provides usable space behind doors 1006E and 1006I, i.e., shelving or other storage systems. In this maximum width of system 1000, one may still use a television of considerably lesser width, i.e., it is not necessary to have cabinets 1002 and 1004 snuggly fit or accommodate a television on base 1006.

Alternatively, to employ furniture system 1000 in an adjustable mode, i.e., to accommodate an object having less than a predefined maximum width between cabinets 1002 and 1004 such as a television, one may detach removable modules 1006C and/or 1006D attached to base 1006 (depending on whether adjustment is one-way or two-way). Additionally, shelving portion 1038C, if in place, may be removed to permit sliding a portion of base 1006 into cabinet 1004 (a similar portion may be detached from cabinet 1002 if two-way adjustment is employed).

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A furniture system comprising:
a first cabinet;
a second cabinet; and
a base for supporting a provided object between the first cabinet and the second cabinet;
wherein one or both of the first cabinet and the second cabinet defines a space for which, in a first configuration of the system, the base resides outside of the space, and in a second configuration of the system, the base resides at least partially within the space;
wherein the base includes:
a support structure for supporting the provided object between the first cabinet and the second cabinet, the support structure having a first end and a second end;
a first module removably coupled to the first end; and
a second module removably coupled to the second end;
wherein the first cabinet includes a first member with a first aperture adjacent to a first portion of the space and the second cabinet includes a second member with a second aperture adjacent to a second portion of the space; and
wherein the first aperture and the second aperture each have a predefined cross-sectional shape to respectively receive portions of the first end and the second end of the support structure after the first and second modules are detached.

2. The system of claim 1 wherein the first cabinet and the second cabinet both define the space.

3. The system of claim 1 wherein the base comprises a console.

4. The system of claim 1 wherein the provided object comprises an audio visual system component.

5. The system of claim 1 wherein the provided object comprises a home theater display.

6. The system of claim 1 wherein the first configuration of the system has the first module coupled to the first end of the support structure and the second module coupled to the second end of the support structure and the second configuration of the system has the first module detached from the first end of the support structure or the second module detached from the second end of the support structure or both the first module detached from the first end of the support structure and the second module detached from the second end of the support structure.

7. The system of claim 1 wherein the space is within portions of one or both of the first cabinet and the second cabinet.

8. The system of claim 1 wherein the predefined cross-sectional shape comprises two or more intersecting linear segments.

9. The system of claim 8 wherein the two or more intersecting linear segments intersect orthogonally.

10. The system of claim 1 wherein the first module includes a plurality of shelves accessible through a first door movably coupled to the support structure, the first door including a removable panel.

11. The system of claim 10 wherein the first cabinet includes a plurality of shelves accessible through a door movably coupled to the first cabinet and which when opened exposes the plurality of shelves in the first cabinet and a first portion of the space.

12. The system of claim 11 wherein in the second configuration of the system, the first module is detached and the plurality of shelves accessible through the door movably coupled to the first cabinet may be accessed by opening the door movably coupled to the first cabinet and traversing an opening formed by the removal of the panel in the first door.

13. The system of claim 12 wherein the second module includes a plurality of shelves accessible through a second door movably coupled to the support structure, the second door including a removable panel.

14. The system of claim 13 wherein the second cabinet includes a plurality of shelves accessible through a door movably coupled to the second cabinet and which when opened exposes the plurality of shelves in the second cabinet and a second portion of the space.

15. The system of claim 14 wherein in the second configuration of the system, the second module is detached and the plurality of shelves accessible through the door movably coupled to the second cabinet may be accessed by opening the door movably coupled to the second cabinet and traversing an opening formed by the removal of the panel in the second door.

16. The system of claim 14 wherein one or more of the plurality of shelves in the second cabinet includes a portion that must be removed before moving the system into the second configuration.

17. The system of claim 11 wherein one or more of the plurality of shelves in the first cabinet includes a portion that must be removed before moving the system into the second configuration.

18. The system of claim 1 further including an adjustable light bridge coupled between the first cabinet and the second cabinet.

19. The system of claim 1 further including an adjustable shelf coupled between the first cabinet and the second cabinet.

* * * * *